US008790125B1

(12) United States Patent
Lee

(10) Patent No.: US 8,790,125 B1
(45) Date of Patent: Jul. 29, 2014

(54) SIGNAL CONNECTOR MODULE

(71) Applicant: Rich Electric Wire and Cable Co. Ltd., Yunlin (TW)

(72) Inventor: Chang-Chi Lee, Yunlin (TW)

(73) Assignee: Rich Electric Wire and Cable Co. Ltd., Yunlin County (TW)

( * ) Notice: Subject to any disclaimer, the term of this patent is extended or adjusted under 35 U.S.C. 154(b) by 14 days.

(21) Appl. No.: 13/773,808

(22) Filed: Feb. 22, 2013

(30) Foreign Application Priority Data

Feb. 6, 2013 (CN) ..... 2013 1 0048075

(51) Int. Cl.
*H01R 13/44* (2006.01)
*H01R 13/60* (2006.01)

(52) U.S. Cl.
CPC ..... *H01R 13/60* (2013.01)
USPC ..... 439/131; 439/638; 439/502

(58) Field of Classification Search
CPC ..... H01R 13/72; H01R 31/065; H01R 35/04; H01R 31/06; H01R 13/44
USPC ..... 439/131, 135, 638, 501
See application file for complete search history.

(56) References Cited

U.S. PATENT DOCUMENTS

| | | | | |
|---|---|---|---|---|
| 6,786,743 | B2 * | 9/2004 | Huang | 439/131 |
| 7,035,126 | B1 * | 4/2006 | Lanni | 439/501 |
| 7,407,393 | B2 * | 8/2008 | Ni et al. | 439/131 |
| 7,494,350 | B1 * | 2/2009 | Lee | 439/131 |
| 7,632,113 | B2 * | 12/2009 | Finn | 439/131 |
| 7,909,624 | B2 * | 3/2011 | Iida | 439/131 |
| 2009/0197443 | A1 * | 8/2009 | Wei et al. | 439/131 |
| 2010/0281209 | A1 * | 11/2010 | Ni et al. | 439/131 |
| 2012/0126956 | A1 * | 5/2012 | Trzecieski et al. | 340/12.5 |
| 2012/0149220 | A1 * | 6/2012 | Lin et al. | 439/131 |

* cited by examiner

*Primary Examiner* — Briggitte R Hammond
(74) *Attorney, Agent, or Firm* — Ming Chow; Sinorica, LLC

(57) ABSTRACT

A signal connector module including a housing, a first connector, a second connector, and a first positioning member. The first connector is received in the chamber of the housing and is able to be moved out of the housing. The second connector is electrically connected to the first connector, and is moved between a first position, in which the second connector is received in chamber of the housing, and a second position, in which the second connector is moved out of the housing. The first positioning member is provided on the second connector to hold the second connector at the first position or at the second position.

8 Claims, 12 Drawing Sheets

SIGNAL CONNECTOR MODULE

The current application claims a foreign priority to the patent application of China No. 201310048075.2 filed on Feb. 6, 2013.

BACKGROUND OF THE INVENTION

1. Field of the Invention

The present invention relates generally to a connector, and more particularly to a signal connector module.

2. Description of the Related Art

In the present market, there are a variety of connectors on various electronic devices, and Universal Serial Bus (USB) is the most common connector. However, there are several types of USB connectors, including Type-A, Type-B, mini USB, and micro USB. Some manufacturers even developed their own type of USB connector. As a result, it needs a specified USB cable for the connection of two electronic devices with different types of connectors.

The conventional USB cable has a cable and two connectors at opposite ends of the cable. The connectors respectively engage two electronic devices, such as computer and mobile phone, for transmission of signals and power. In present days, we have a lot of USB cables stored in a box in a mess. Furthermore, the connectors of the USB cable may be damaged accidently.

SUMMARY OF THE INVENTION

The primary objective of the present invention is to provide a signal connector module, which is convenient for storage and provides a protection of the connectors.

According to the objective of the present invention, a signal connector module including a housing, a first connector, a second connector, and a first positioning member. The housing has a chamber therein, a first opening, a second opening, and a first bore. The first opening, the second opening, and the first bore are communicated with the chamber. The housing further has a first locking portion and a second locking portion. The first connector is received in the chamber of the housing and is able to be moved out of the housing through the first opening. The second connector is electrically connected to the first connector. The second connector is moved between a first position, in which the second connector is received in chamber of the housing, and a second position, in which the second connector is moved out of the housing through the second opening. The first positioning member, which is provided on the second connector, has a first controlling portion and a first engaging portion. The first controlling portion is received in the first bore of the housing and is able to move in the first bore to be operated by a user to move the second connector between the first position and the second position. The first engaging portion engages the first locking portion when the second connector is moved to the first position, and the first engaging portion engages the second locking portion when the second connector is moved to the second position.

Therefore, the signal connector module of the present invention may be operated and stored in an easy way.

DETAILED DESCRIPTION OF THE INVENTION

Figure 1:
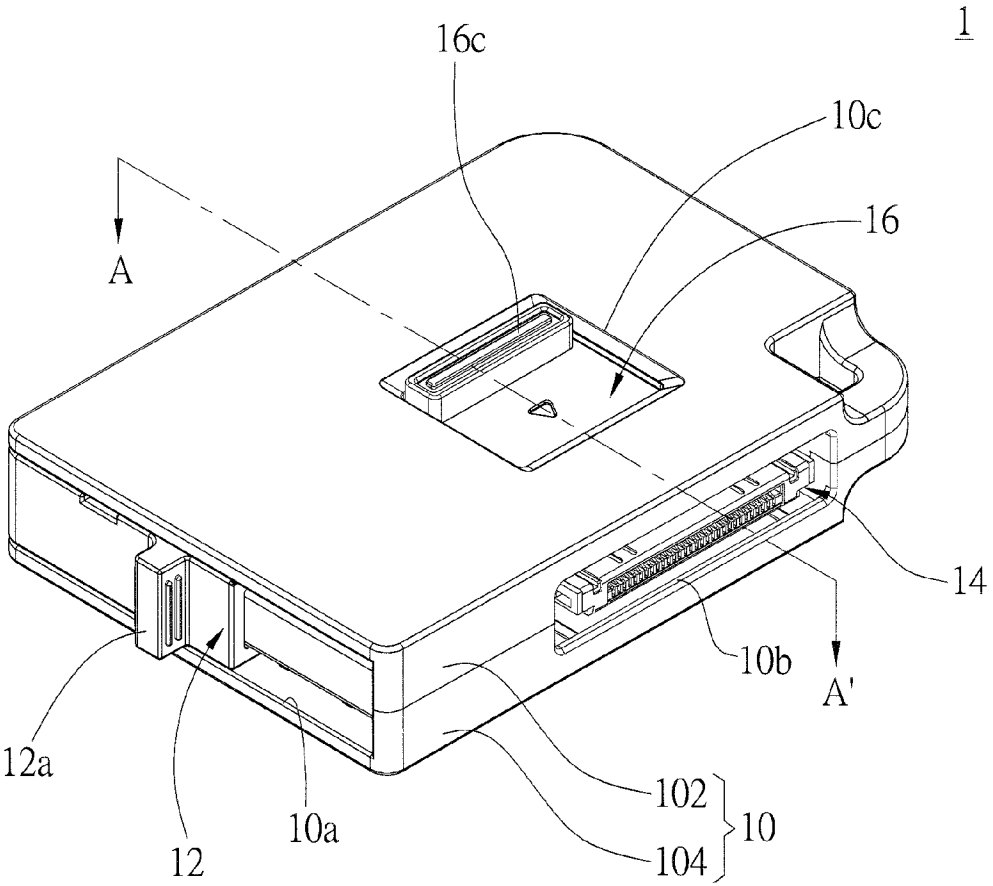
FIG. 1 is a perspective view of a first preferred embodiment of the present invention.
Figure 2:
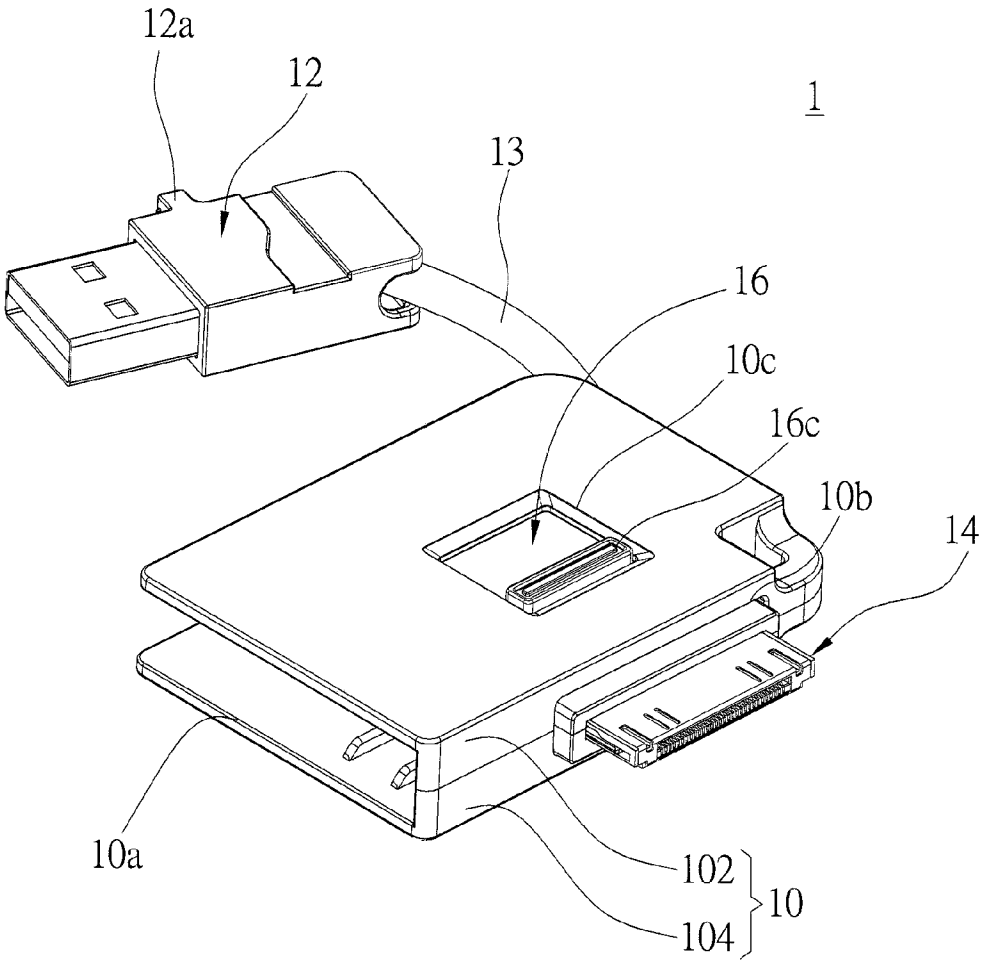
FIG. 2 is another perspective view of the first preferred embodiment of the present invention.
Figure 3:
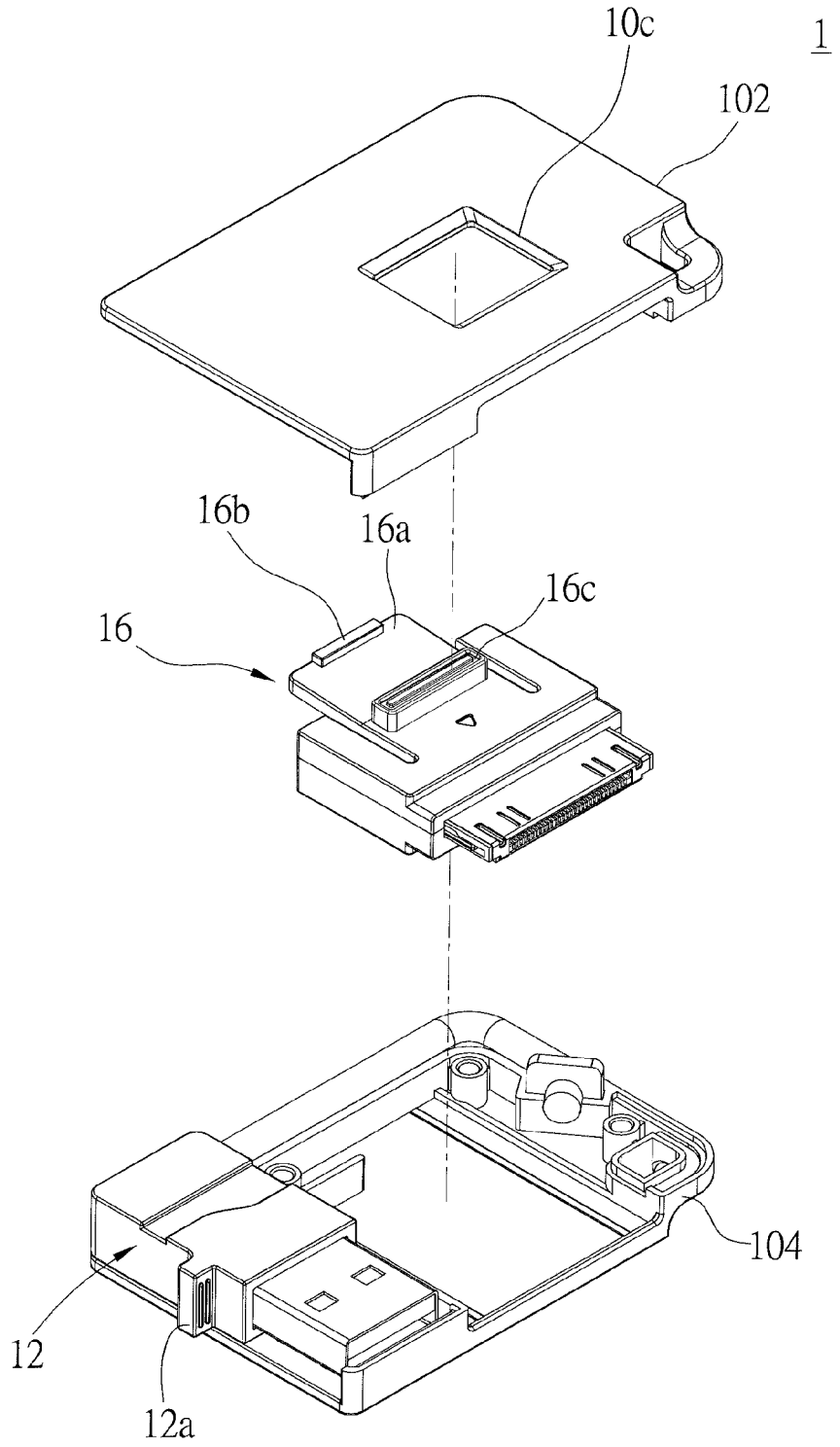
FIG. 3 is an exploded view of the first preferred embodiment of the present invention.

The detailed description and technical contents of the present invention will be explained with reference to the accompanying drawings. However, the drawings are illustrative only but not used to limit the present invention.

As shown in FIGS. from FIG. 1 to FIG. 4C, a signal connector module 1 of the first preferred embodiment of the present invention includes a housing 10, a first connector 12, a second connector 14, and a first positioning member 16.

The housing 10 is a rectangular hollow member, having a top case 102 and a bottom case 104 in connection to obtain a chamber therebetween. The housing 10 has a first opening 10*a*, a second opening 10*b*, and a first bore 10*c*, all of which are communicated with the chamber in the housing 10. The first opening 10*a* and the second opening 10*b* are on a peripheral side of the housing 10, and the first bore 10*c* are on the top case 102 (a top of the housing 10). The top case 102 has two recesses 10*d*, 10*e* on an inner side thereof. A predetermined distance is between the recesses 10*d*, 10*e*. The recess 10*d* forms a first locking portion, and the other recess 10*e* forms a second locking portion.

A wire 13 is connected to the first connector 12 so that the first connector 12 may be received in the housing 10 or moved out of the housing 10 through the first opening 10*a*. The first connector 12 has a protrusion 12*a* for a user to move the first connector 12.

The second connector 14 is electrically connected to the first connector 12. The second connector 14 and the first connector 12 are different types of connectors. The second connector 14 is slidably mounted in the housing 10 to be moved between a first position P1 (FIG. 4A) and a second position P2 (FIG. 4C). The second connector 14 is received in the housing 10 when it is at the first position P1, and is moved out of the housing 10 via the second opening 10*b* when it is moved to the second position P2.

The first positioning member 16 is provided on the second connector 14. In an embodiment, the first positioning member 16 has a first flexible plate 16*a*, a protrusion 16*b*, and a first block 16*c*. The first flexible plate 16*a* has an end connected to the second connector 14 and the other end suspended. The protrusion 16*b* is on the suspended end of the first flexible plate 16*a*. The protrusion 16*b* fits the recesses 10*d*, 10*e*. The first block 16*c* is on a top side of the first flexible plate 16*a* and is in the first bore 10*c* of the housing 10. A user may press the first block 16*c* to move the second connector 14 to make the protrusion 16*b* engage the recess 10*d* or the recess 10*e*. In an embodiment, the first block 16*c* form a first controlling portion for a user to move the second connector 14, and the protrusion 16*b* forms a first engaging portion to engage the first locking portion or the second locking portion.

Figure 4A:
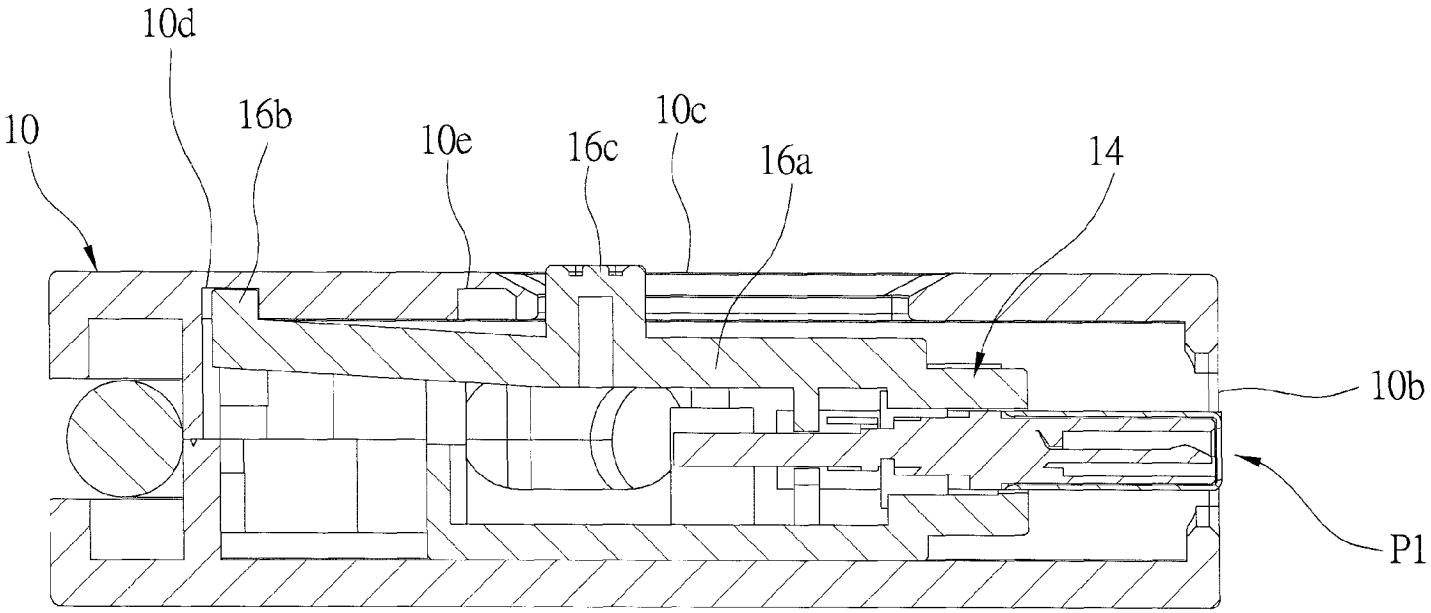
FIG. 4A, FIG. 4B, and FIG. 4C are sectional views in the A-A' line of FIG. 1, showing how the second connector is moved out.
Figure 4B:
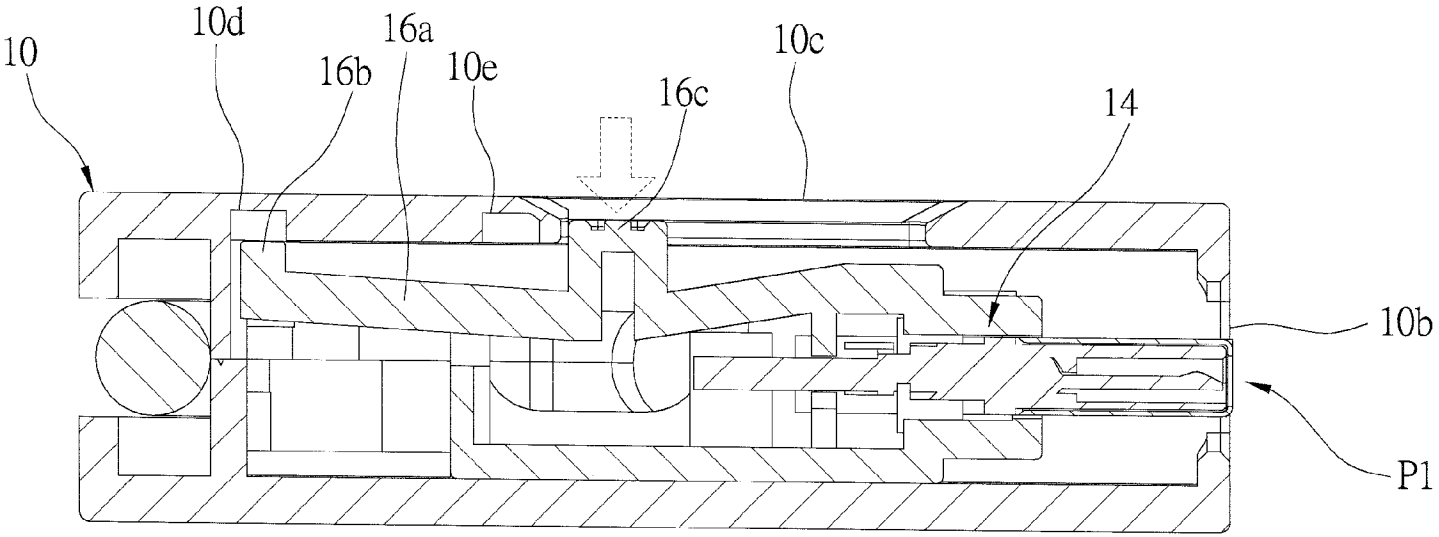
Figure 4C:
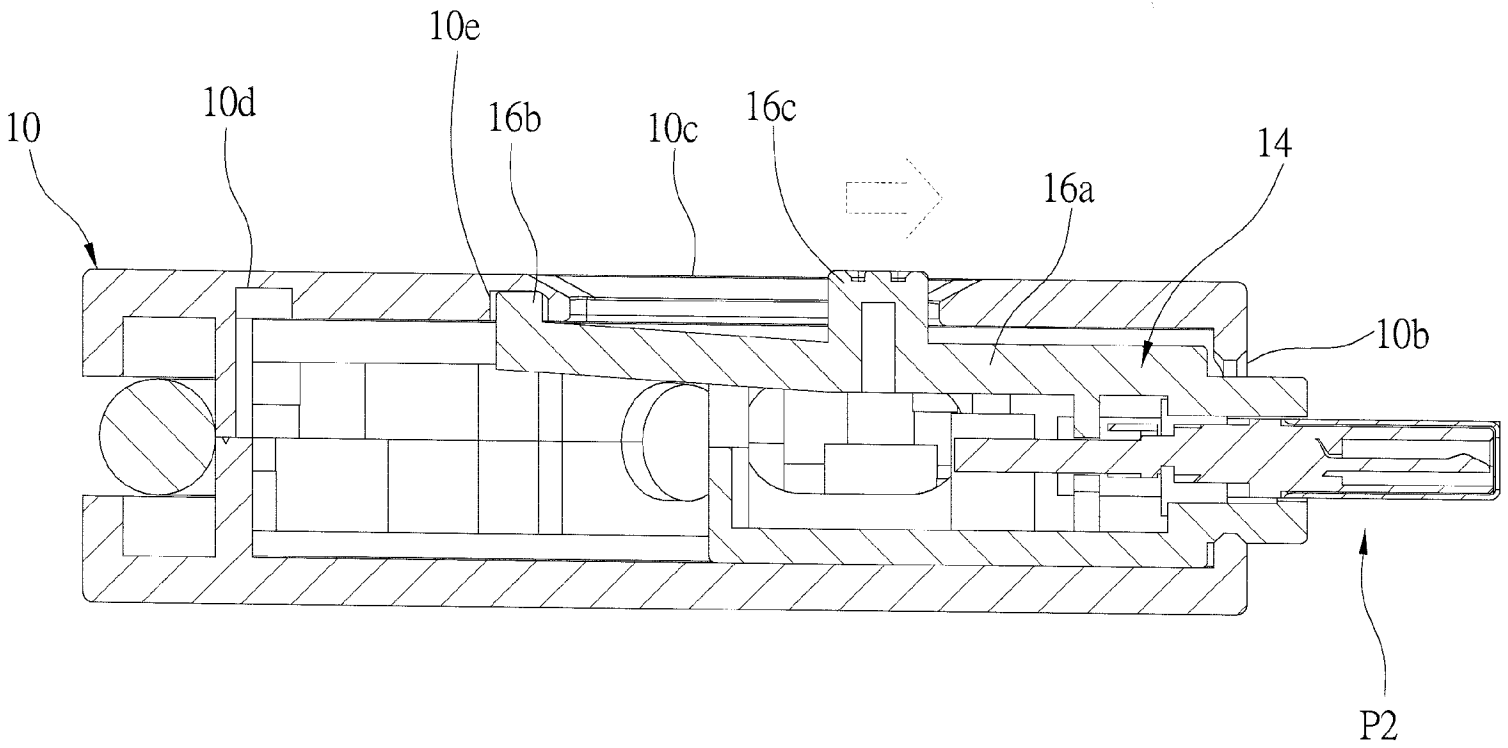
Figure 5:
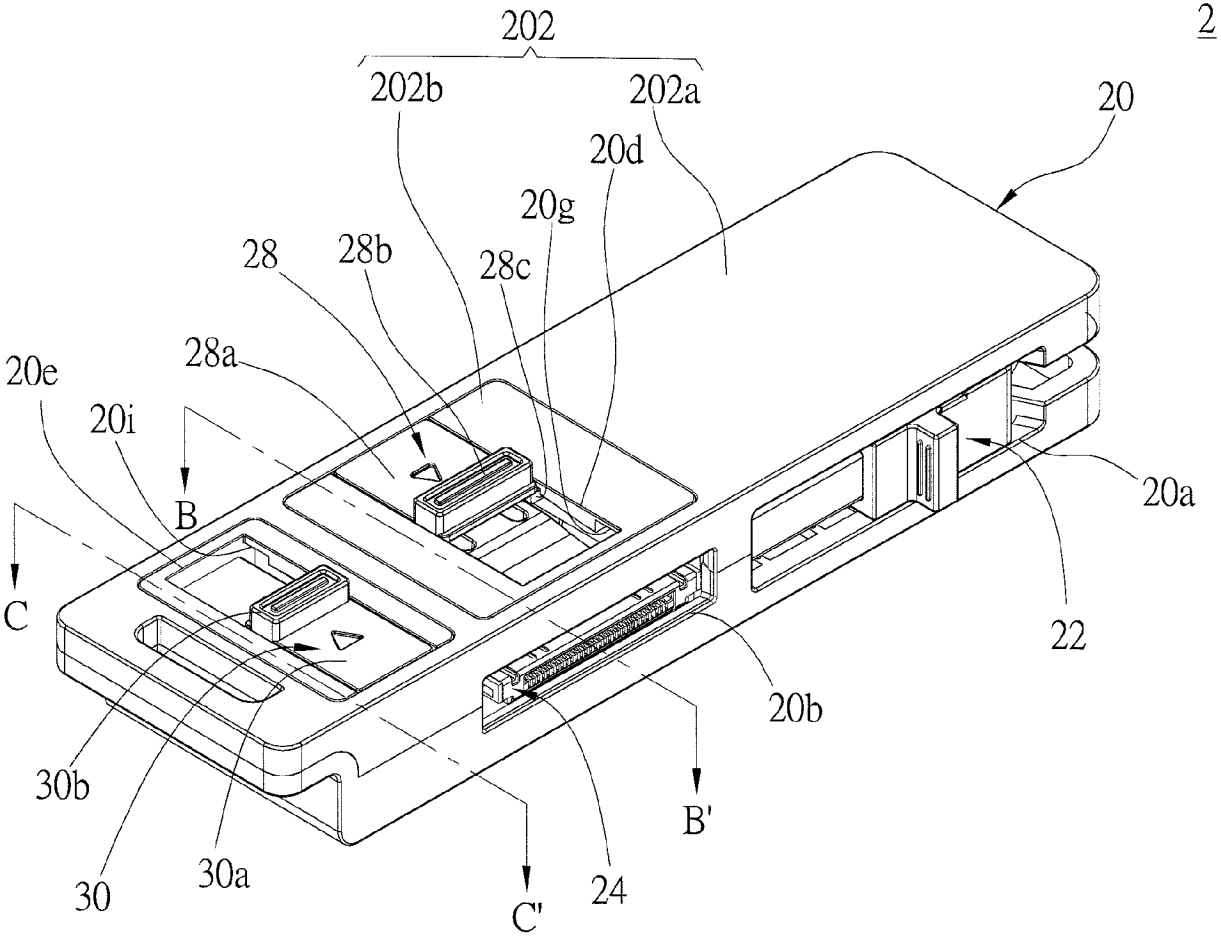
FIG. 5 is a perspective view of a second preferred embodiment of the present invention.
Figure 6:
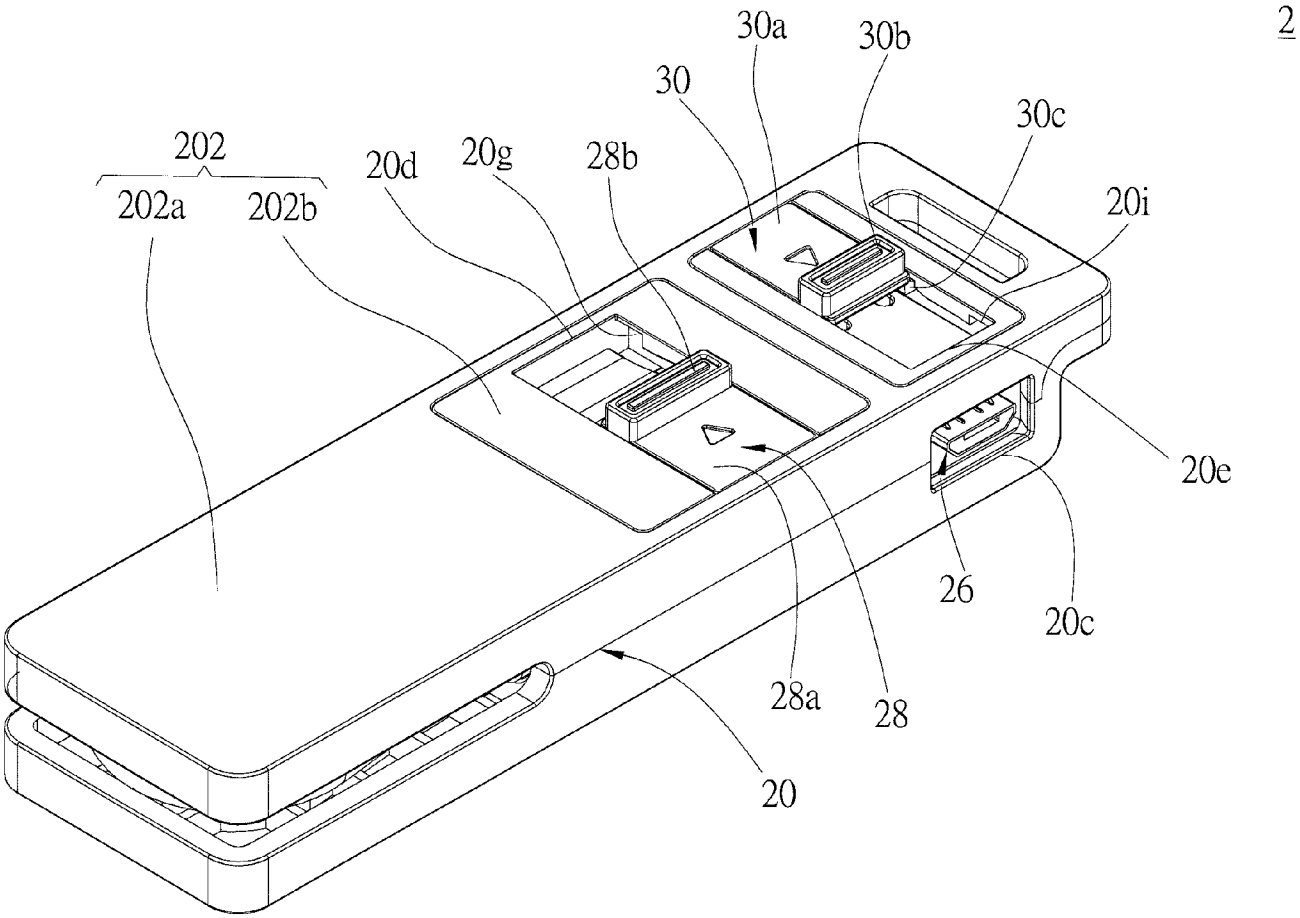
FIG. 6 is another perspective view of the second preferred embodiment of the present invention.
Figure 7:
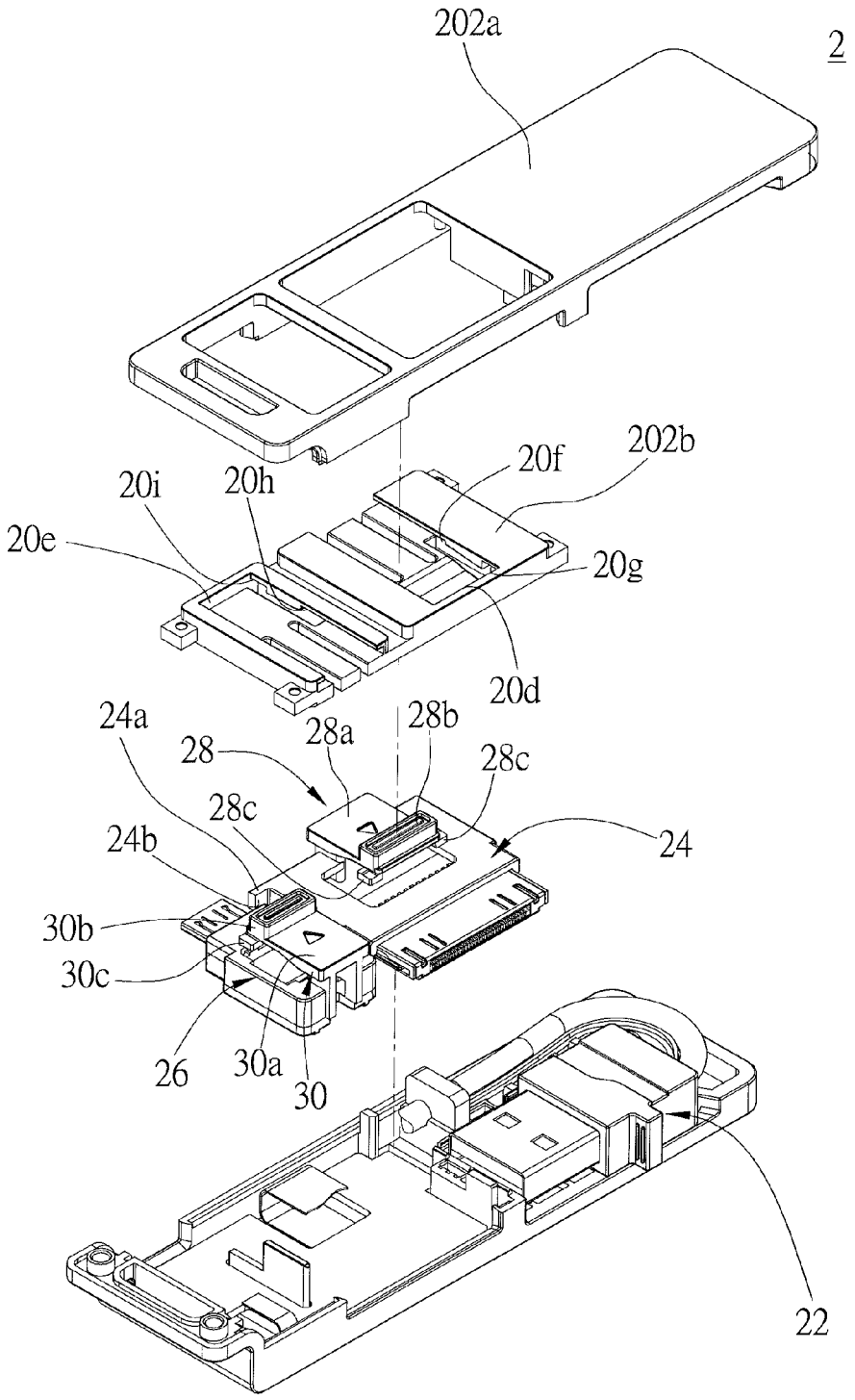
FIG. 7 is an exploded view of the second preferred embodiment of the present invention.
Figure 8A:
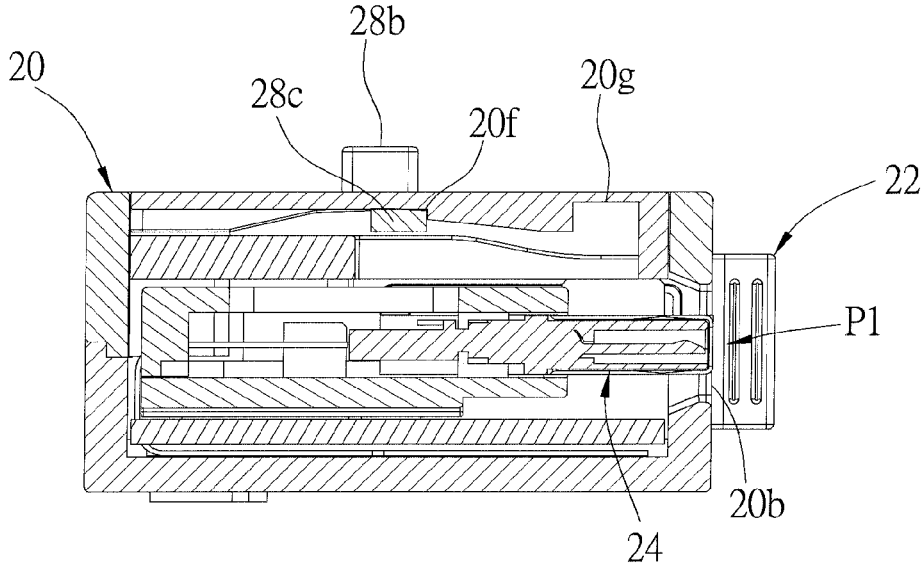
FIG. 8A and FIG. 8B are sectional views in the B-B' line of FIG. 5, showing how the second connector is moved out.
Figure 8B:
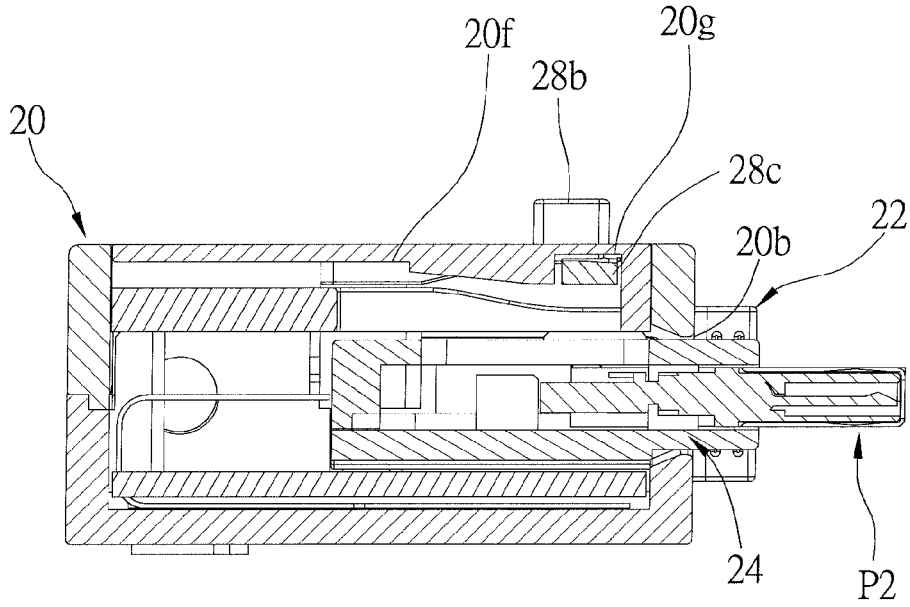

As shown in FIG. 4A, FIG. 4B, and FIG. 4C, the first block 16*c* is moved in the first bore 10*c*. While the first block 16*c* is moved to an end of the first bore 10*c*, which is distal to the second opening 10*b*, the second connector 14 is moved to the first position P1 and is totally received in the housing 10. At this time, the protrusion 16*b* engages the recess 10*d* (FIG. 4A) to hold the second connector 14 at the first position P1. As shown in FIG. 4B, while the user presses the first block 16*c*, the protrusion 16*b* disengages the recess 10*d*, and the user is able to move the first block 16*c* to the other end of the first bore 10*c*, which is proximal to the second opening 10*b*. Now, the second connector 14 is moved out of the housing 10 through the second opening 10*b* (to the second position P2). While the first block 16*c* is moved to a predetermined position, the protrusion 16*b* engages the recess 10*e* (FIG. 4C) to hold the second connector 14 at the second position P2. At this time, the second connector 14 is able to engage a connector of an electronic device. On the contrary, the user may press the first block 16*c* to disengage the protrusion 16*b* with the recess 10*e*, and now, the first block 16*c* may be moved back to receive the second connector 14 in the housing 10.

FIGS. from FIG. 5 to FIG. 12 show a signal connector module 2 of the second preferred embodiment, which includes a housing 20, a first connector 22, a second connector 24, a third connector 26, a first positioning member 28, and a second positioning member 30.

The housing 20 has a first opening 20*a*, a second opening 20*b*, a third opening 20*c*, a first bore 20*d*, and a second bore 20*e*. The second opening 20*b* and the third opening 20*c* are at opposite sides of the housing 20. The housing 20 has a top case 202, and the top case 202 has a top plate 202*a* and a pressing plate 202*b*. The first bore 20*d* and the second bore 20*e* are on the pressing plate 202*b*.

The pressing plate 202*b* has two recesses 20*f* on an inner side thereof, and the recesses 20*f* are at opposite sides of the first bore 20*d*. The recesses 20*f* form a first locking portion. The pressing plate 202*b* further has two recesses 20*g* on the inner side thereof to form a second locking portion. There is a predetermined distance between the recesses 20*f* and the recesses 20*g*. The pressing plate 202*b* further has two recesses 20*h* on the inner side thereof, and the recesses 20*h* are at opposite sides of the second bore 20*e*. The recesses 20*h* form a third locking portion. The pressing plate 202*b* further has two recesses 20*i* on the inner side thereof to form a fourth locking portion. There is a predetermined distance between the recesses 20*h* and the recesses 20*i*.

A wire is connected to the first connector 22 so that the first connector 22 may be received in the housing 20 or moved out of the housing 10 through the first opening 20*a*. The first, the second, and the third connectors 22, 24, 26 are three different types of connectors, and the second and the third connectors 24, 26 are electrically connected to the first connector 22 respectively. The second connector 24, which is the same as above, is received in the housing 20 or is moved out of the housing 10 through the second opening 20*b*. The third connector 26 is slidably mounted in the housing 20 to be moved between a third position P3 (FIG. 9A), in which the third connector 26 is received in the housing 20, and a fourth position P4 (FIG. 9B), in which the third connector 26 is moved out of the housing 10 through the third opening 20*c*.

The first positioning member 28 includes a first flexible plate 28*a*, a first block 28*b*, and two protrusions 28*c*. An end of the first flexible plate 28*a* is fixed to the third connector 26, and the other end thereof is suspended. The first block 28*b* and the protrusions 28*c* are on the first flexible plate 28*a*. The first block 28*b* is adjacent to the suspended end of the first flexible plate 28*a*, and the protrusions 28*c* are on opposite sides of the first block 28*b*. The first block 28*b* is in the first bore 20*d*. The second positioning member 30 includes a second flexible plate 30*a*, a second block 30*b*, and two protrusions 30*c*. An end of the second flexible plate 30*a* is fixed to the second connector 24, and the other end thereof is suspended. The second block 30*b* and the protrusions 30*c* are on the second flexible plate 30*a*. The second block 30*b* is adjacent to the suspended end of the second flexible plate 30*a*, and the protrusions 30*c* are on opposite sides of the second block 30*b*. The second block 30*b* is in the second bore 20*e* and is able to move in the second bore 20*e*. The second block 30*b* forms a second controlling portion, and the protrusions 30*c* form a second engaging portion.

The user may press the first block 28*b* of the first positioning member 28 to move the second connector 24 between a first position P1 (FIG. 8A), in which the second connector 24 is received in the housing 20, and a second position P2 (FIG. 8B), in which the second connector 24 is moved out of the housing 20 through the second opening 20*b*.

Figure 9A:
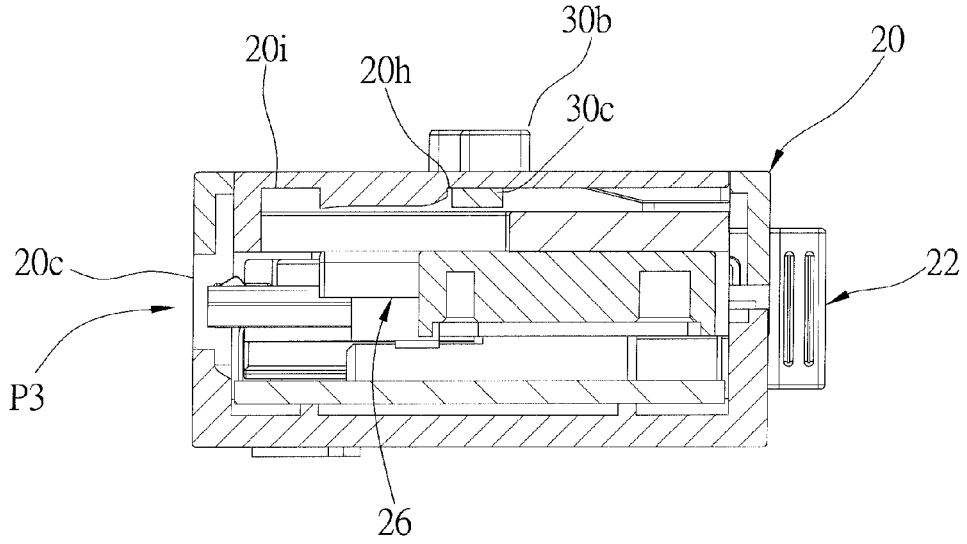
FIG. 9A and FIG. 9B are sectional views in the C-C' line of FIG. 5, showing how the third connector is moved out.
Figure 9B:
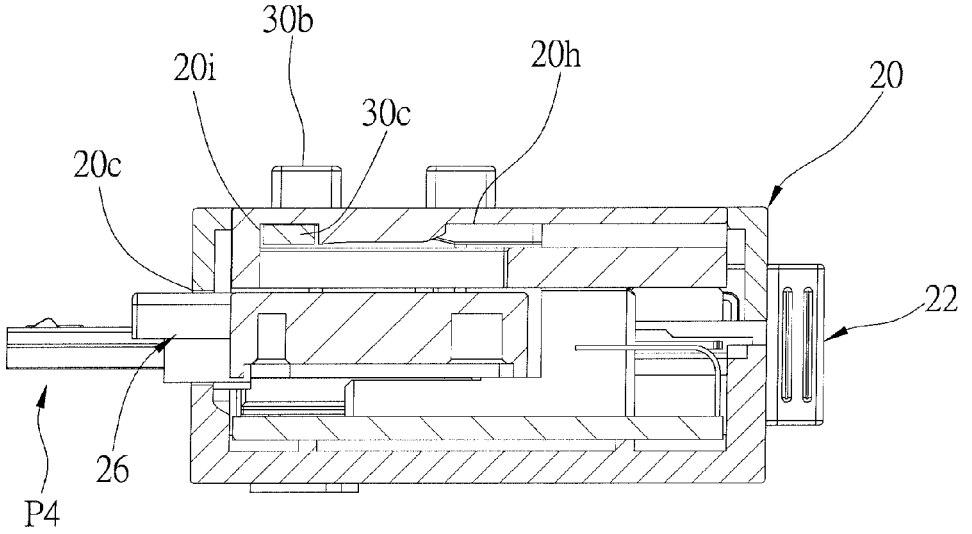

As shown in FIG. 9A and FIG. 9B, the user may press the second block 30*b* of the second positioning member 30 to move the third connector 26 between a third position P3 (FIG. 9A) and a fourth position P4 (FIG. 9B). At the third position P3, the third connector 26 is received in the housing 20, and the protrusions 30 engage the recesses 20*h*. At the fourth position P4, the third connector 26 is moved out of the housing 20 through the third opening 20*c*, and the protrusions 30 engage the recesses 20*i*.

Figure 10:
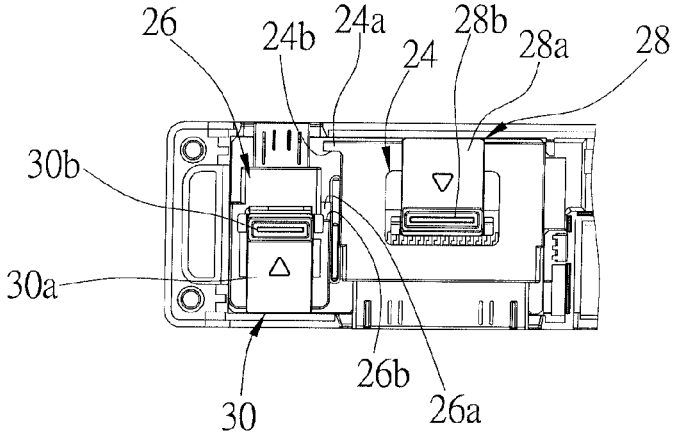
FIG. 10 is a sectional view of the second preferred embodiment of the present invention, showing both the second connector and the third connector in the housing.
Figure 11:
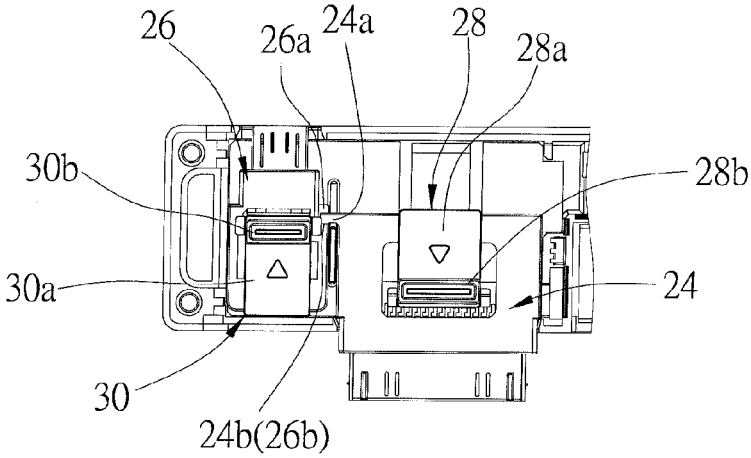
FIG. 11 is a sectional view of the second preferred embodiment of the present invention, showing the second connector being moved out of the housing.
Figure 12:
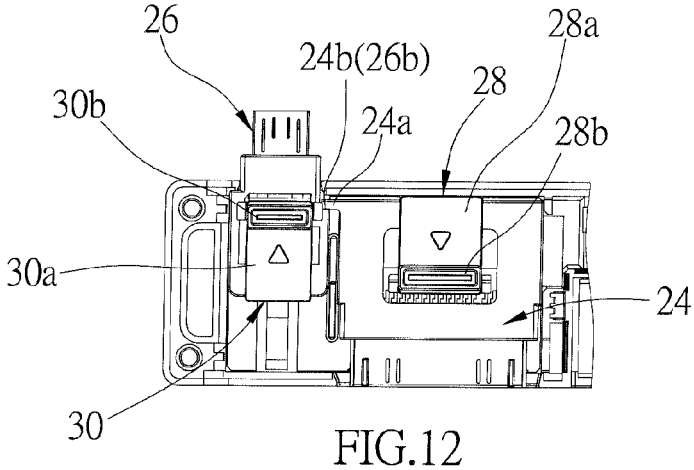
FIG. 12 is a sectional view of the second preferred embodiment of the present invention, showing the third connector being moved out of the housing.

In an embodiment, the second connector 24 has a stop block 24*a*, and the third connector 26 has a recess 26*a*. The stop block 24*a* is in association with the recess 26*a*. The stop block 24*a* has a first stop face 24*b*, and a second stop face 26*b* is formed on a sidewall of the recess 26*a*. The first stop face 24*b* faces the second stop face 26*b*. While both the second connector 24 and the third connector 26 are received in the housing 20, the first stop face 24*b* is kept a distance away from the second stop face 26*b* (FIG. 10). While the user is moving the second connector 24 out of the housing 20, the first stop face 24*b* is moved toward the second stop face 26*b*, and while the second connector 24 is moved to the first position P1, the first stop face 24*b* touches the second stop face 26*b*. As a result, the third connector 26 is unable to be moved (FIG. 11). On the contrary, while the second connector 24 is received in the housing 20 and the third connector 26 is moved out of the housing 20, the second stop face 26*b* touches the first stop face 24*b* to make the second connector 24 stay in the housing 20 (FIG. 12). The function of it is that only one of the second connector 24 and the third connector 26 may be moved out of the housing 20, or both of them are received in the housing 20.

In conclusion, the signal connector module of the present invention provides a variety of plugs and sockets for connection, and they van be operated and stored in an easy way. Furthermore, it also provides that only one connector can be pulled out for connection at the same time. The description above is only a few preferred embodiments of the present invention and the equivalence of the present invention is still in the scope of claim construction of the present invention.

What is claimed is:

1. A signal connector module, comprising:

a housing having a chamber therein, a first opening, a second opening, and a first bore, wherein the first opening, the second opening, and the first bore are communicated with the chamber, and the housing further has a first locking portion and a second locking portion;

a first connector, which is received in the chamber of the housing and is able to be moved out of the housing through the first opening;

a second connector, which is electrically connected to the first connector, wherein the second connector is moved between a first position, in which the second connector is received in chamber of the housing, and a second position, in which the second connector is moved out of the housing through the second opening; and a first positioning member, which is provided on the second connector, having a first controlling portion and a first engaging portion, wherein the first controlling portion is received in the first bore of the housing and is able to move in the first bore to be operated by a user to move the second connector between the first position and the second position; the first engaging portion engages the first locking portion when the second connector is moved to the first position, and the first engaging portion engages the second locking portion when the second connector is moved to the second position.

2. The signal connector module as defined in claim 1, wherein the first positioning member has a first flexible plate; an end of the first flexible plate is connected to the second connector, and an opposite end thereof is suspended, and the first controlling portion and the first engaging portion are provided on the first flexible plate.

3. The signal connector module as defined in claim 2, wherein the first locking portion has at least one recess on the housing; the second locking portion has at least one recess on the housing, and the first engaging portion has at least one protrusion to engage the recess of the first locking portion when the second connector is moved to the first position and to engage the recess of the second locking portion when the second connector is moved to the second position.

4. The signal connector module as defined in claim 1, further comprising a third connector and a second positioning member, wherein the housing further includes a third opening, a third bore, a third locking portion, and a fourth locking portion; the third connector is electrically connected to the first connector; the third connector is moved between a third position, in which the third connector is received in the chamber of the housing, and a fourth position, in which the third connector is moved out of the housing through the third opening; the second positioning member is provided on the third connector and has a second controlling portion and a second engaging portion; the second controlling portion is received in the second bore of the housing and is able to move in the second bore to be operated by a user to move the third connector between the third position and the fourth position; the second engaging portion engages the third locking portion when the third connector is moved to the third position, and the second engaging portion engages the fourth locking portion when the third connector is moved to the fourth position.

5. The signal connector module as defined in claim 4, wherein the second positioning member has a second flexible plate; an end of the second flexible plate is connected to the second connector and an opposite end thereof is suspended; and the second controlling portion and the second engaging portion are provided on the second flexible plate.

6. The signal connector module as defined in claim 5, wherein the third locking portion has at least one recess on the housing; the fourth locking portion has at least one recess on the housing, and the second engaging portion has at least one protrusion to engage the recess of the third locking portion when the third connector is moved to the third position and to engage the recess of the fourth locking portion when the third connector is moved to the fourth position.

7. The signal connector module as defined in claim 6, wherein the second connector has a first stop face, and the third connector has a second stop face; the first stop face is kept a predetermined distance away from the second stop face when both the second connector and the third connector are received in the chamber of the housing; the first stop face is moved toward the second stop face and touches the second stop face when the third connector is at the third position and the second connector is moved from the first position to the second position, whereby the second connector is moved out of the housing, and the third connector is held in the chamber of the housing; the second stop face is moved toward the first stop face and touches the first stop face when the second connector is at the first position, and the third connector is moved from the third position to the fourth position, whereby the third connector is moved out of the housing, and the second connector is held in the chamber of the housing.

8. The signal connector module as defined in claim 7, wherein the second connector has stop block, on which the first stop face is provided, and the third connector has a recess, on a sidewall of which the second stop face is provided.

* * * * *